US005086294A

United States Patent [19]

Kasegi

[11] Patent Number: 5,086,294

[45] Date of Patent: Feb. 4, 1992

[54] INDICATOR CIRCUIT FOR PROTECTING LIGHT EMITTING DIODE

[75] Inventor: Hiroshi Kasegi, Shimane, Japan

[73] Assignee: Omron Tateisi Electronics Co., Kyoto, Japan

[21] Appl. No.: 685,667

[22] Filed: Apr. 16, 1991

Related U.S. Application Data

[63] Continuation of Ser. No. 503,106, Apr. 2, 1990, abandoned, which is a continuation of Ser. No. 346,730, May 3, 1989, abandoned.

[30] Foreign Application Priority Data

May 10, 1988 [JP] Japan ..... 63-61886[U]

[51] Int. Cl.[5] ..... G08B 21/00

[52] U.S. Cl. ..... 340/644; 340/641; 361/18; 361/93; 323/312

[58] Field of Search ..... 340/644, 641, 638, 870.39; 361/93, 18, 90; 323/312-315, 311, 222; 307/318

[56] References Cited

U.S. PATENT DOCUMENTS 3,624,481 11/1971 Macharg ..... 323/313
4,328,586 5/1982 Hansen ..... 370/32
4,710,699 12/1987 Miyamoto ..... 361/93
4,712,056 12/1987 Schott ..... 323/315
4,779,027 10/1988 Sikora ..... 361/90
4,808,975 2/1989 Hochhaus ..... 340/641

FOREIGN PATENT DOCUMENTS 3424617 1/1985 Fed. Rep. of Germany ..... 340/644
2356338 1/1978 France ..... 340/641

*Primary Examiner*—Jin F. Ng
*Assistant Examiner*—Jill Jackson
*Attorney, Agent, or Firm*—Fish & Richardson

[57] ABSTRACT

An indicator circuit for indicating the states of various electric components such as limit switches, comprising a light emitting device such as a light emitting diode, and a constant current device, such as a constant current diode, connected in series with the light emitting element. The constant current element significantly expands the operable range of the input voltage to the indicator circuit, and keeps the brightness of the light emitting device constant over a wide input voltage range. For high voltage applications, a plurality of constant current devices may be connected in series, and, preferably, balancing resistors and/or zener diodes may be connected in parallel with them.

8 Claims, 2 Drawing Sheets

INDICATOR CIRCUIT FOR PROTECTING LIGHT EMITTING DIODE

This application is a continuation of U.S. application Ser. No. 07/503,106, filed Apr. 2, 1990, now abandoned, which is a continuation of U.S. Ser. No. 07/346,730, filed May 3, 1989, now abandoned.

TECHNICAL FIELD

The present invention relates to an indicator circuit using a light emitting device to indicate the states of electric components and circuits.

BACKGROUND OF THE INVENTION

Light emitting diodes are widely used as indicator lamps in association with various electric components and circuits since light emitting diodes consume relatively little power and generate little heat as compared with conventional incandescent indicator lamps. One such application is found in indicator lamps for indicating the states of limit switches. However, light emitting diodes are sensitive to voltage fluctuations. If the applied voltage is excessively high, the light emitting diode may be destroyed. Conversely, if the applied voltage is excessively low, the brightness of the light emitting diode may become insufficient and may even stop producing any light. Therefore, there has been a demand for light emitting diode indicators which can perform satisfactorily even when there is a fluctuation in the voltage applied thereto.

Light emitting diode indicators may be adapted to different voltages by properly selecting the values of the resistors connected in series with the corresponding light emitting diodes. Therefore, it has been necessary to stock a large number of light emitting diode indicators having different voltage ratings in order to meet different requirements. This means an increase in the manufacturing cost, and more significantly an increase in the maintenance cost of each system using light emitting diode indicators.

BRIEF SUMMARY OF THE INVENTION

In view of such problems of the prior art, a primary object of the present invention is to provide an indicator circuit which can operate over a wide range of operating voltage in a satisfactory manner.

A second object of the present invention is to provide an indicator circuit which can contribute to the reduction in the manufacturing and maintenance cost of the systems using such indicators.

These and other objects of the present invention can be accomplished by providing an indicator circuit, comprising: a first input terminal; a second input terminal; a constant current device, such as a constant current diode, having one end connected to the first input terminal; a indicator device, such as a light emitting diode, having one end connected to another end of the constant current device and another end connected to the second input terminal.

Thus, since a constant current is supplied to the light emitting diode with the constant current device, the light emitting diode may be properly operated without destroying it even when the applied voltage is changed, and the brightness of the light emitting diode may be kept constant irrespective of the change in the applied voltage.

To the end of avoiding the problems arising from surge voltage, it is preferred to connect a zener diode between the one end of the constant current device and the other end of the indicator device.

To expand the operable operating voltage beyond the breakdown voltage of the constant current device, an additional constant current device may be connected in series with the first mentioned constant current device, preferably with a balancing resistor being connected in parallel with each of the constant current devices.

According to a preferred embodiment of the present invention, the indicator circuit comprises a series circuit of a pair of constant current devices, a light emitting device connected in series therewith, a first zener diode connected between the end the series circuit adjoining the first input terminal and the node between the constant current devices, and a second zener diode connected between the node between the constant current devices and the other end of the indicator device.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
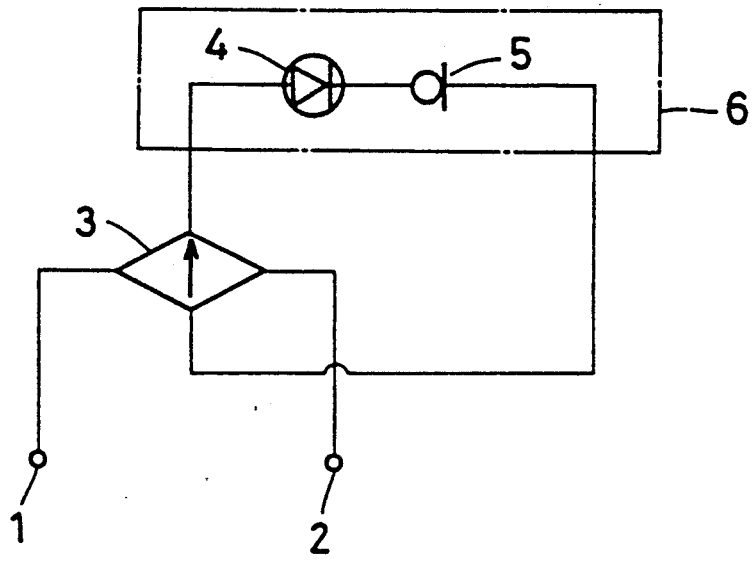
FIG. 1 is an electric circuit diagram of a limit switch to which the operation indicator circuit of the present invention is applied.

FIG. 1 is an electric circuit diagram of an operation indicator circuit for a switch according to the present invention applied to a limit switch.

In this drawing, numerals 1 and 2 denote AC power source input terminals and numeral 3 denotes a bridge rectifying circuit connected to the power source input terminals. Numeral 4 denotes a light emitting device, such as a light emitting diode, for indicating the operation of a limit switch not shown in the drawings, and numeral 5 denotes a constant current device consisting of a constant current diode connected in series with the light emitting diode 4. The serial connection of the two diodes 4 and 5 are connected to the output end of the bridge rectifying circuit 3 as an operation indicator circuit 6.

In the above described structure, the rated operation voltage range of the constant current diode 5 is 10 to 100 volts, and the constant current diode 5 produces a constant current for application voltages within this range. In other words, the risk of destroying the light emitting diode 4 by using a wrong circuit element as was the case with the conventional arrangement based on the selection of a resistor can be eliminated, and since a constant current (approximately 1.0 mA or less) is supplied to the light emitting diode 4 a constant brightness can be obtained even when the power source voltage fluctuates.

When opening and closing an inductive load, a surge voltage in produced, and the constant current diode 5 having a operable voltage range of from 10 to 100 volts will be placed under overload condition. Since the breakdown voltage of the constant current diode 5 in such overload condition is 130 to 160 volts, and since the AC 100 volt means a peak voltage of 141 volts, such an arrangement may create a problem.

Figure 2:
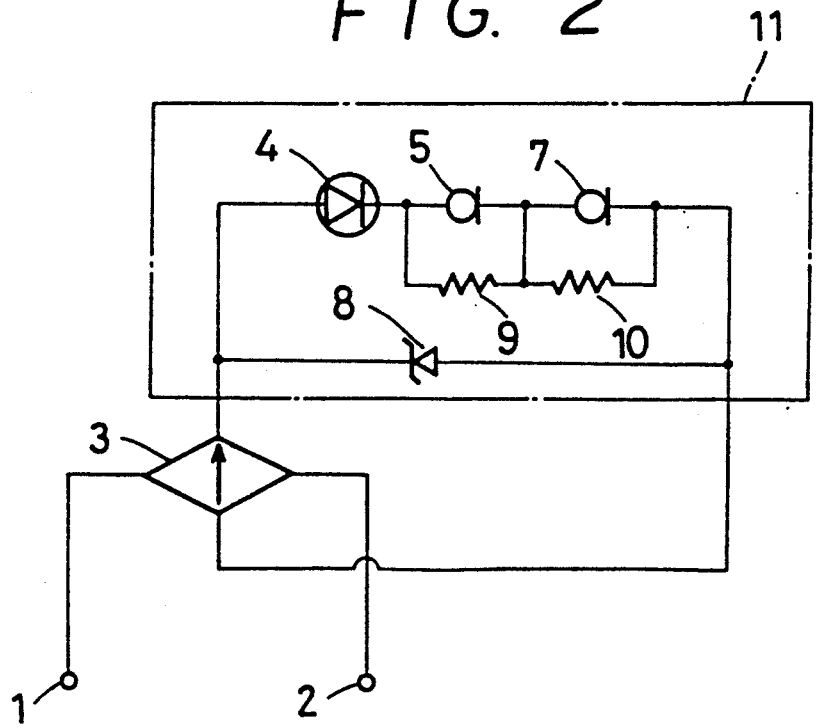
FIGS. 2 and 3 are circuit diagrams of limit switches according to other embodiments of the present invention.

An embodiment which accounts for such a problem is illustrated in FIG. 2. In this drawing, a pair of constant current diodes 5 and 7 which are connected in series one another are connected in series with a light emitting diode 4. The series circuit of the constant current diodes 5 and 7 and the light emitting diode 4 is connected in parallel with a constant voltage device for suppressing surge current, consisting of, for instance, a zener diode 8. Numerals 9 and 10 are resistors for balancing the constant current diodes 5 and 7 which are connected in parallel with these resistors.

In the above described structure, noise immunity of the circuit is enhanced through suppression of surge current by the use of the zener diode 8. Further, by the use of the two constant current diodes 5 and 7, the breakdown voltage of the circuit is doubled to about 260 volts, as compared with the case where only one such constant current diode is used. As a result, the current conducted through the light emitting diode is kept constant, and its handling is improved.

Figure 3:
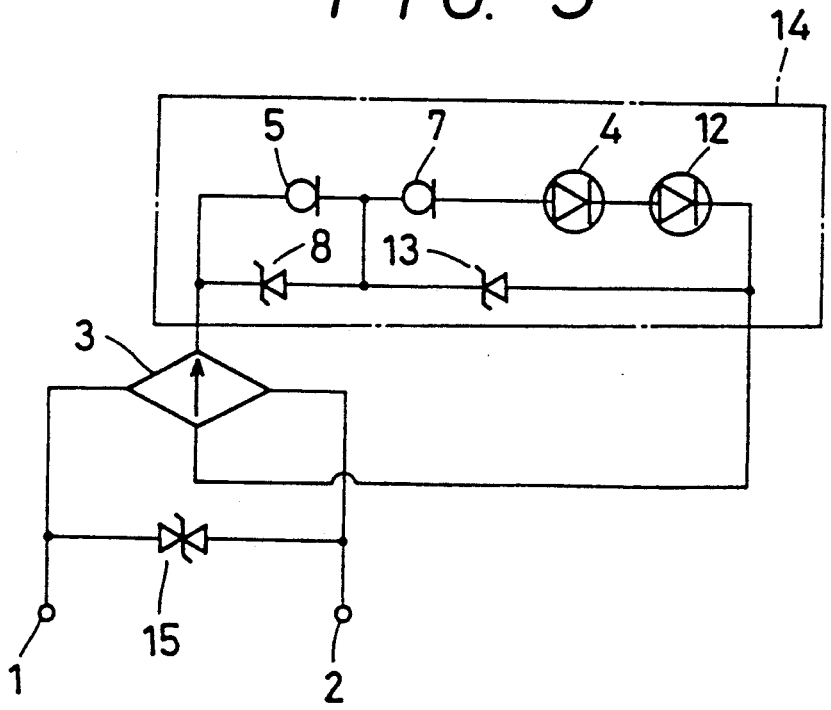

In the above described embodiment illustrated in FIG. 2, the cost of the component parts was reduced by using resistors 9 and 10 in addition to the two constant current diodes 5 and 7 and using only one zener diode, but other variations are possible. For instance, as shown in FIG. 3, it is possible to connect a series circuit of a pair of light emitting diodes 4 and 12 to a series circuit of two constant current circuits 5 and 7 with a zener diode 8 connected in parallel with one of the constant current diodes 5 and another zener diode 13 connected in parallel with the series circuit of the other constant current diode 7 and the light emitting diodes 4 and 12. Optionally, a protection diode 15 for surge current suppression may be connected across the power source terminals 1 and 2.

The above described embodiments pertained to the applications to limit switches, but it is obvious that the present invention may also be applied to various switches other than limit switches.

What I claim is:

1. An indicator circuit, comprising:

a first input terminal;

a second input terminal;

a constant current device having one end connected to said first input terminal, said constant current device comprising a first constant current circuit connected in parallel with a first resistor, a second constant current circuit connected in parallel with a second resistor, said first constant current circuit and said first resistor connected in series with said second constant current circuit and said second resistor;

an indicator device having one end connected to another end of said constant current device and another end connected to said second input terminal; and a voltage surge protection circuit having one end connected to said first input terminal and another end connected to said second input terminal.

2. An indicator circuit according to claim 1, wherein said voltage surge protection circuit comprises a zener diode.

3. An indicator circuit according to claim 2, wherein said indicator device is a light emitting diode.

4. An indicator circuit according to claim 3, wherein said first and said second constant current circuits each comprise a constant current diode.

5. An indicator circuit according to claim 1, wherein said indicator device is a light emitting diode.

6. An indicator circuit according to claim 1, wherein said first and said second constant current circuits each comprise a constant current diode.

7. An indicator circuit according to claim 6, wherein said voltage surge protection circuit comprises a zener diode.

8. An indicator circuit, comprising:

a first input terminal;

a second input terminal;

a first constant circuit having one end connected to said first input terminal, said first constant current circuit connected in parallel with a first voltage surge protection circuit, a constant current indicator device having one end connected to another end of said first contact current circuit and another end connected to said second input terminal, said constant current indicator device comprising a second constant current circuit in series with at least one indicator device, said second current circuit and said indicator device connected in parallel with a second voltage surge protection circuit.

* * * * *